US005492252A

United States Patent [19]

Gueret

[11] Patent Number: 5,492,252

[45] Date of Patent: Feb. 20, 1996

[54] DISPENSING ASSEMBLY DUE TO CONTROL AIR UPTAKE IN CONTACT WITH FLUID PRODUCT

[75] Inventor: Jean-Louis H. Gueret, Paris, France

[73] Assignee: L'Oreal, Paris, France

[21] Appl. No.: 325,156

[22] Filed: Oct. 20, 1994

[30] Foreign Application Priority Data

Oct. 22, 1993 [FR] France ..... 93 12641

[51] Int. Cl.[6] ..... B65D 37/00

[52] U.S. Cl. ..... 222/207; 222/321.1

[58] Field of Search ..... 222/207, 321, 222/325, 494; 137/854

[56] References Cited

U.S. PATENT DOCUMENTS

| | | | |
|---|---|---|---|
| 1,991,126 | 2/1935 | Stevenson . | |
| 2,815,890 | 12/1957 | Cooprider et al. . | |
| 2,853,210 | 9/1958 | Stewart et al. . | |
| 3,527,551 | 9/1970 | Kutik et al. . | |
| 3,910,458 | 10/1975 | Ewald . | |
| 4,789,082 | 12/1988 | Sampson . | |
| 5,176,510 | 1/1993 | Nilsson | 222/207 X |
| 5,197,637 | 3/1993 | Naumann . | |
| 5,271,432 | 12/1993 | Gueret | 222/207 X |
| 5,271,513 | 12/1993 | Crosnier et al. . | |
| 5,339,972 | 8/1994 | Crosnier et al. . | |
| 5,360,145 | 11/1994 | Gueret | 222/207 X |

FOREIGN PATENT DOCUMENTS

| | | |
|---|---|---|
| 0410857 | 1/1991 | European Pat. Off. . |
| 0442858 | 8/1991 | European Pat. Off. . |
| 0441377 | 8/1991 | European Pat. Off. . |
| 0452260 | 10/1991 | European Pat. Off. . |
| 0524854 | 1/1993 | European Pat. Off. . |
| 0538162 | 4/1993 | European Pat. Off. . |
| 2015035 | 4/1970 | France . |
| 2542820 | 9/1984 | France . |
| 2573819 | 5/1986 | France . |
| 2688424 | 9/1993 | France . |
| 2140509 | 11/1984 | United Kingdom . |
| WO90/05091 | 5/1990 | WIPO . |

*Primary Examiner*—Gregory L. Huson
*Attorney, Agent, or Firm*—Young & Thompson

[57] ABSTRACT

Assembly for dispensing a liquid to pasty product, includes a container holding the product, and a dispensing head having a dispensing channel. The material of the container has a rigidity such that the dispensing of the product requires air-uptake by the container. A pumping member having an inlet valve and a dispensing valve is provided for dispensing the product. The pumping member is of the type having no air-uptake. The assembly includes elements for selectively establishing or preventing air-uptake by the container. The dispensing head possesses a bearing surface having a flexible diaphragm defining a springy leaf applied against the end of the bearing surface into which the dispensing channel emerges.

15 Claims, 4 Drawing Sheets

DISPENSING ASSEMBLY DUE TO CONTROL AIR UPTAKE IN CONTACT WITH FLUID PRODUCT

FIELD OF THE INVENTION

The present invention relates to an assembly for dispensing a fluid product, in the form of a liquid or paste, with controlled air uptake.

BACKGROUND OF THE INVENTION

Many dispensing systems are known which include a container, holding the product to be dispensed, and a dispensing head having a dispensing channel communicating, on the one hand, with the container holding the product to be dispensed and, on the other hand, with the outside; a pumping member enables the user to dispense the product at will.

It is known that, when the container, of any type, consists of a material which is quite rigid, it is necessary for the upper part of the container to be at atmospheric pressure, that is to say in communication with the atmosphere, in order for the dispensing of the product to be able to be carried out, while air uptake by the container takes place; in order to do this, two-valve air-uptake pumps have already been proposed as pumping member.

U.S. Pat. No. 2,815,890 discloses a dispensing assembly in which means are provided for establishing or preventing, at will, air uptake by the container, by virtue of the dispensing head being mounted so as to be rotationally movable with respect to the container. Contact with the air by the product in the container may thus be reduced over time, thus enabling the product in the container to be protected from possible degradation.

However, after dispensing the product, part of the latter remains in the dispensing channel; this part of the product is in contact with air during the air uptake by the dispensing head and during storage; the product may therefore be degraded by oxidation or contaminated by impurities in the air and, during subsequent dispensing, the product dispensed may have lost its intrinsic qualities, or indeed have become harmless.

SUMMARY OF THE INVENTION

The object of the invention is, especially, to provide a dispensing assembly of the kind defined hereinabove which keeps the product likely to remain in the dispensing channel protected from air. Furthermore, this dispensing assembly could have a simple and inexpensive construction and operate reliably.

In addition, it will be understood that the invention is applicable to a dispensing assembly which may or may not include a dip tube.

According to the invention, an assembly for dispensing a fluid product, in the form of a liquid or paste, with controlled air uptake, of the kind defined previously, is characterized in that the dispensing head possesses a bearing surface into which emerges the terminal part, opening onto the outside, of the dispensing channel passing through the dispensing head, which head bears, in its upper part, a flexible diaphragm having a bevelled profile defining a springy leaf applied against the end of the part into which the dispensing channel emerges.

Preferably, the bearing surface is plane and its plane is interrupted at the centre of the dispensing head by a hollowed region extending down to a bottom and forming a compression chamber into which the other end of the dispensing channel emerges.

The compression chamber is bordered on the outside by a dome which the diaphragm possesses in line with the bottom.

Preferably, means are provided for establishing or preventing, at will, communication between the dispensing channel and the container and are formed by the dispensing head being mounted so as to be movable, with respect to the container, between two positions, a position for which the dispensing head is in communication with the container and a position for which the said communication is closed.

Advantageously, the two positions of the dispensing head, relative to the container, for which the container is, or is not, in communication with the atmosphere, are the same as those for which, respectively, the dispensing channel is, or is not, in sleeve communication with the container.

According to one embodiment, the dispensing head is mounted so as to rotate with respect to the container; the container is a rigid bottle to which a support is fixed, the dispensing head being axially integral with the said support and free to rotate with respect to it; the support possesses an internal cylindrical outer skirt housed in a sealed manner in the annular space lying between an internal tubular part and an external tubular part which the dispensing head possesses.

More precisely, a port passes through the wall of the internal cylindrical outer skirt of the support, the internal and external tubular parts of the dispensing head being respectively provided with a longitudinal slot and the internal and external tubular parts of the dispensing head being respectively provided with a longitudinal slot and with a passage, these facing each other, the passage emerging into the compression chamber of the pumping member and including the inlet valve, the internal cylindrical inner skirt of the support and the internal tubular part of the dispensing head communicating with the container, the longitudinal slot and the passage being placed so as to face the port in that position of the dispensing head with respect to the support for which communication between the compression chamber of the pumping member and the container, and therefore between the dispensing channel and the container, is open.

As a variant, the assembly comprises a dip tube going down to near the lower part of the rigid bottle and being connected, in its upper part, to the internal cylindrical outer skirt of the support.

Advantageously, the means for venting to atmosphere are formed by an axial groove, provided in the inner surface of the external cylindrical outer skirt of the support and emerging into the container, and by another groove, made in the outer surface of the outer tubular part of the dispensing head and emerging into the outside of the container.

According to another variant, the dispensing head comprises a ferrule mounted so as to rotate on a support fixed to the neck of the container, this ferrule making it possible to open or close an air-uptake hole in the container, and possessing, in its central part, a valve-piston interacting with a pumping chamber formed in a push-button on top of the ferrule.

Advantageously, the valve-piston is formed by a projection in the central part of a flat region of the ferrule, the upper, particularly dome-shaped, end of which possesses at least one passage covered by a springy diaphragm having a cylindrical wall which slides in a sealed manner in an internal skirt of the push-button.

The projection of the ferrule may possess, at its top, a frustoconical stud engaged in a circular orifice in the diaphragm.

Preferably, the dispensing channel emerges on the lateral wall of the push-button, where the bearing surface for the springy leaf is located.

BRIEF DESCRIPTION OF THE DRAWINGS

The invention will be better understood with reference, in an illustrative but non-limiting manner, to the appended drawings in which.

DETAILED DESCRIPTION OF THE INVENTION

Figure 2:
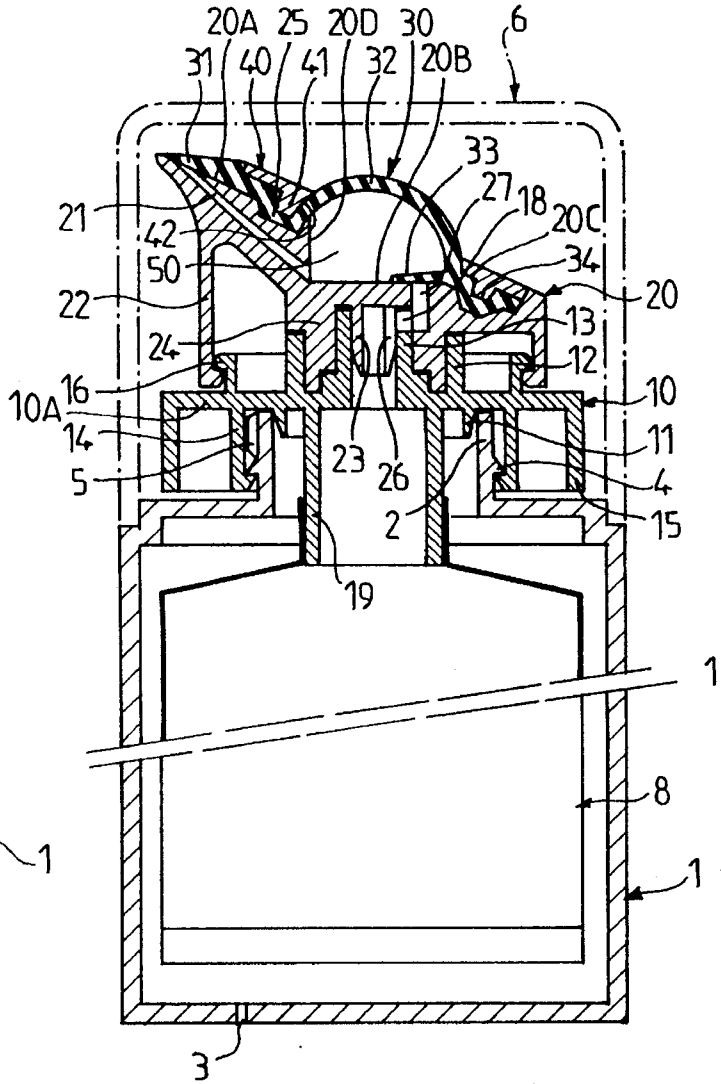
FIG. 2 is a sectional partial view on a larger scale of the assembly of FIG. 1.
Figure 1:
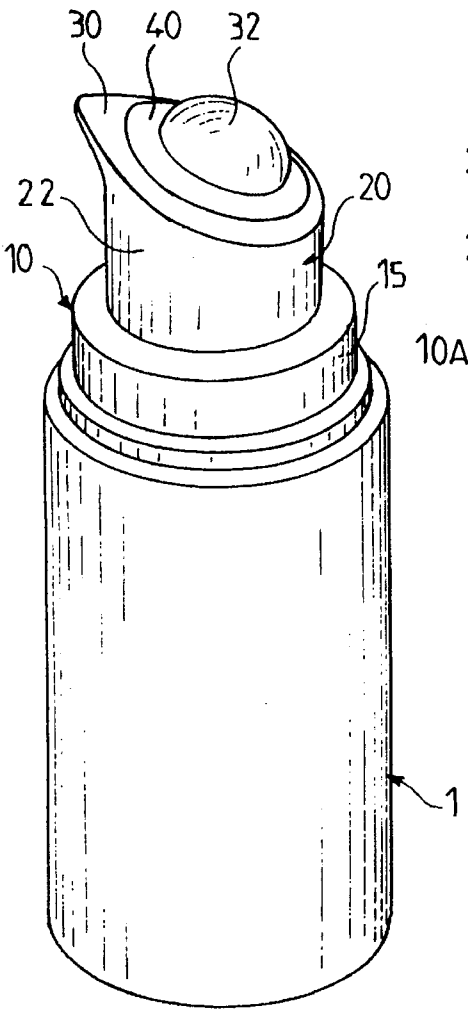
FIG. 1 is a perspective general view showing a dispensing assembly according to the invention.

Referring to FIGS. 1 and 2, a dispensing assembly according to the invention comprises a rigid bottle 1 having a neck 2 bearing a snap-fastening shoulder 4 at its outer periphery.

The bottle 1 is designed to receive a support 10 for a dispensing head 20.

The support 10 possesses concentric cylindrical skirts of circular cross-section extending from a transverse wall 10A, on either side of said wall; the said skirts extend with respect to this wall 10A either towards the bottle 1, in which case they are called inner skirts, or from the side opposite the bottle 1, in which case they are called outer skirts; thus, the support 10 possesses two outer skirts, namely an external outer skirt 12 and an internal outer skirt 13, and two inner skirts, namely an external inner skirt 15 and an internal inner skirt 14; the internal inner skirt 14 possesses, in its lower part, a snap-fastening shoulder interacting with the snap-fastening shoulder 4 of the neck 2 of the bottle 1 in order to render the support axially integral with the bottle 1; furthermore, anti-rotation fins 5, placed axially between the neck 2 and the said internal inner skirt 14, also prevent the support 10 from rotating with respect to the bottle 1; the support 10 and the bottle 1 are rendered integral in a sealed manner by virtue of an annular sealing lip 11 borne by the support 10 and applied against the upper edge of the neck 2 of the bottle 1.

The dispensing head 20 has a cylindrical general shape of revolution with a truncated upper part; more precisely, the dispensing head 20 possesses a cylindrical outer case 22, of circular cross-section, the lower part of which is snap-fastened onto a snap-fastening ring 16 borne by the support 105 by virtue of this arrangement, the dispensing head 20 is held in place axially with respect to the same support 10 while still being able to rotate with respect to the said support 10.

At the upper part, the dispensing head 20 possesses a plane bearing surface 20A extending in a plane perpendicular to the plane of FIG. 2 and inclined to the axis of the bottle 1; this plane is interrupted at the centre of the dispensing head 20 by a hollowed region 50 bordered by a semi-cylindrical wall 20A extending down to a transverse bottom 20B and intended, as described hereinbelow, to form a compression chamber 50.

The dispensing head includes two tubular parts extending towards the support 10, an external tubular part 24 and an internal tubular part 23; the internal outer skirt 13 of the support 10 is housed in a sealed manner in the annular space lying between the said internal 23 and external 24 tubular parts; likewise, the external tubular part 24 of the dispensing head 20 is housed in a sealed manner in the annular space lying between the internal 13 and external 12 outer skirts of the support 10; this baffle-type mounting ensures good sealing of the chamber 50 with respect to the support 10, despite the dispensing head 20 being mounted so as to rotate on the said support 10.

In the example depicted in FIGS. 1 and 2, the container containing the product to be dispensed is a flexible bag 8 housed inside the bottle 1 and rendered integral, in a sealed manner, for example by heat-sealing, with a sleeve 19 of the support 10, this sleeve extending from the transverse wall 10A and prolonging the internal outer skirt 13 of the support 10 towards the bottle 1.

The dispensing head 20 is mounted so as to rotate with respect to the support 10 between at least two positions: a position in which communication between the chamber 50 and the inside of the flexible bag 8 is closed, and a position where the said communication is open; for this purpose, a port 18 passes through the wall of the internal outer skirt 13 of the support 10 and the internal 23 and external 24 tubular parts of the dispensing head 20 are respectively provided with a longitudinal slot 26 and with a passage 27, these facing each other; the passage 27 emerges into the chamber 50 in line with the bottom 20B. With the internal outer skirt 13 of the support 10 and the internal tubular part 23 of the dispensing head 20 communicating with the bag 8, when the longitudinal slot 26 and the passage 27 are placed so as to face the port 18, as is depicted in FIG. 2, communication is established between the chamber 50 and the bag 8; when the dispensing head 20 is rotated, with respect to the support 10, so that this coincidence no longer occurs, the said communication is closed.

The dispensing head 20 bears, at its upper part, a flexible diaphragm 30 covering the plane part 20A of the dispensing head 20; at its highest end, the flexible diaphragm 30 has a bevelled profile defining a springy leaf 31 applied against the end of the plane part 20A into which that terminal part, opening onto the outside, of a dispensing channel 21 passing through the dispensing head 20 emerges and the other end of which dispensing channel emerges into the chamber 50; the said chamber 50 is bordered on the outside by a dome 32 which possesses the diaphragm 30 in line with the bottom 20B; the flexible diaphragm 30 possesses an annular groove 34, surrounding the base of the dome 32, which is received in a corresponding annular groove 25 hollowed out in the plane part 20A of the dispensing head 20; this arrangement enables the diaphragm 30 to be perfectly positioned with respect to the dispensing head 20 and especially the springy leaf 31; it also enables the diaphragm 30 to be effectively fixed; for this purpose, in accordance with the invention, a ring 40 possessing an opening 42 for the passage of the dome 32 possesses an annular projection 41 forcibly fitted into the annular groove 34 of the diaphragm 30; with the ring 40 thus having a generally L-shaped cross-section, it possesses a collar extending parallel to the plane bearing surface 20A, especially in line with the springy leaf 31, and which acts as a member for stressing the leaf 31 applied against its seat 20A, thus ensuring perfect sealing, at rest, of the closure of the dispensing channel 21 with respect to the outside.

Figure 10:
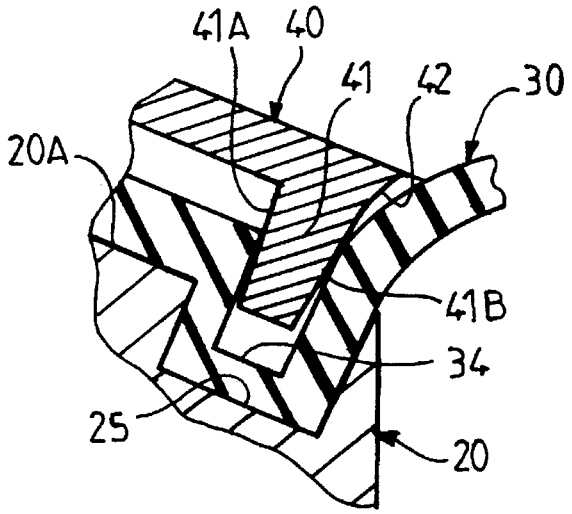
FIG. 10 is a sectional partial view on a large scale illustrating the fixing of the diaphragm by the ring.
Figure 11:
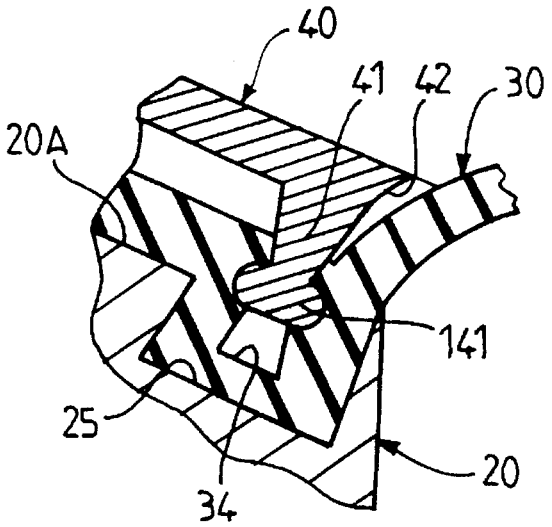
FIG. 11 is similar to FIG. 10 and illustrates an alternative fixing embodiment.

In FIGS. 10 and 11 may be seen examples of profiles of annular grooves 25 and 34 and of an annular projection 41 which have given good results; according to the alternative embodiment of FIG. 10, the annular groove 25 with which the dispensing head 20 is provided has a generally rectangular-shaped cross-section and receives a part of complementary shape of the flexible diaphragm 30 defining a groove 34 also having a generally rectangular-shaped cross-section; the annular projection 41 of the ring 40 is bordered by annular faces 41A, 41B which, on going towards the plane part 20A of the dispensing head 20, are slightly conical; the angle of the cone is, for example, the taper angle usually employed in moulding technology. According to the alternative embodiment of FIG. 11, the annular groove 25 has a generally trapezium-shaped cross-section, the large base of which is on the side of the bottom of the groove 25; the groove 34 of the flexible diaphragm 30 has a complementary shape, also trapezoidal, and the annular projection 41 of the ring 40 bears, at its free end, an annular protuberance 141 which, when the ring 40 is in place, creates a component of transverse force gripping the side walls of the groove 34 of the diaphragm 30 against the reverse-tapered side walls of the groove 25 of the dispensing head 20.

Figure 9:
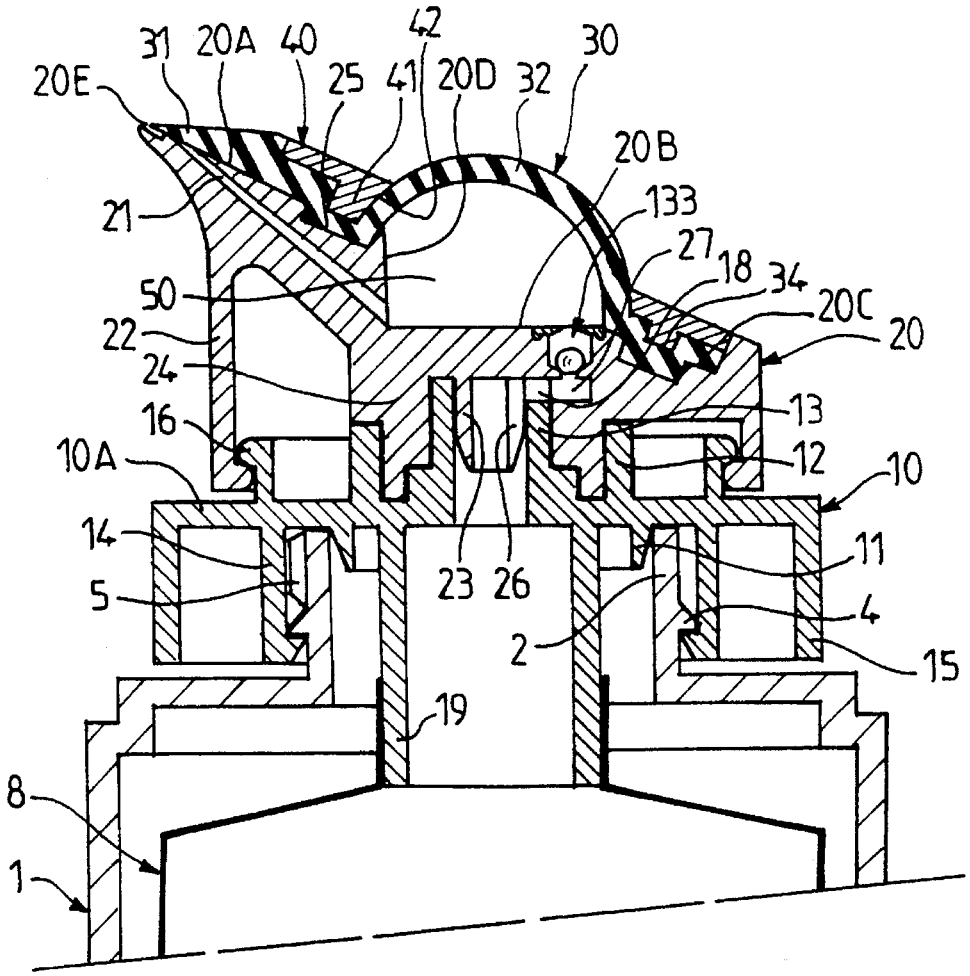
FIG. 9 is a sectional partial view of an alternative embodiment of the dispensing assembly according to FIG. 2, on a larger scale than that of FIG. 2.

By arranging, in line with the passage 27, an inlet valve 33 allowing only the product contained in the bag 8 to pass towards the chamber 50, a dispensing pump is thus formed in a simple manner, the springy leaf 31 acting as the dispensing valve associated with the variable-volume chamber 50; this simplicity is enhanced when, as shown in FIG. 2, the valve 33 is moulded as a single piece with the springy diaphragm 30; since the annular bearing surface 41 is designed to be off-centre with respect to the opening 42, a bearing surface 20C is thus provided in line with the root of the valve 33, this bearing surface stressing the valve 33 in application against its seat 20B, thus improving the efficiency of the dispensing. However, the inlet valve may, of course, be independent of the diaphragm 30, as shown in FIG. 9 in which the said valve is formed by a ball valve 133 arranged in the passage 27; the presence may also be noted in this figure of a U-shaped channel 20E hollowed out in the plane bearing surface 20A of the dispensing head 20 downstream of the dispensing channel 21; the channel 20E enables the product at the outlet of the dispensing channel 21 to be guided, this guiding being all the more useful the more liquid the product dispensed.

The bottom of the bottle 1 is pierced with an air-uptake orifice 3 making it easier for the flexible bag 8 to shrink progressively with the dispensing of the product which it contains; at rest, after use, the product fills the bag 8 and the chamber 50; after having removed the overcap 6 which the assembly comprises and after putting the dispensing head 20 into the position which it occupies in FIG. 2, pressure exerted on the dome 32 pushes the product through the dispensing channel 21, which product lifts up the flap 31 and is dispensed; when the action on the dome 32 ceases, the leaf 31 comes back onto its seat; during the return movement of the dome 32 towards its rest position, the valve 33 is lifted up, allowing the product to pass towards the chamber 50; the bag 8 follows this product transfer without constraint, on account of the air let in via the orifice 3. When putting the assembly into storage, the dispensing head 20 is rotated with respect to the support 10 until the communication between the chamber 50 and the bag 8 is closed; the overcap 6 is then put in place and the product is stored completely safely.

Figure 3:
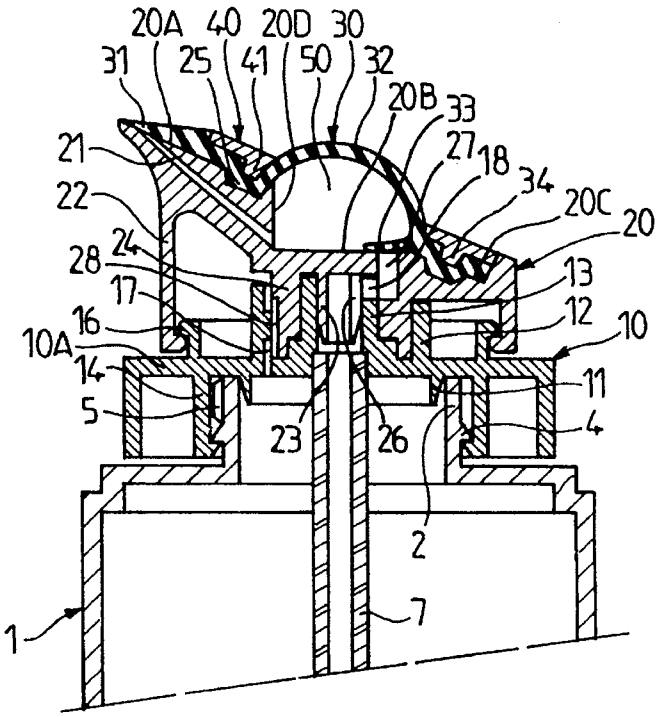
FIG. 3 is a sectional partial view of an alternative embodiment of an assembly according to the invention.
Figure 4:
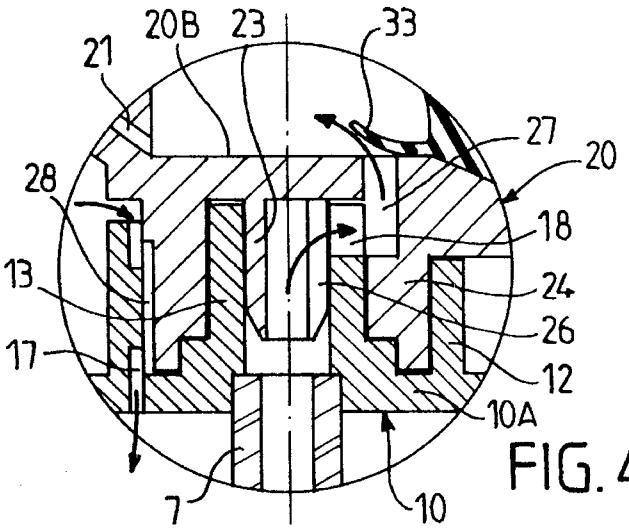
FIG. 4 is a sectional partial view on a larger scale of part of FIG. 3.
Figure 5:
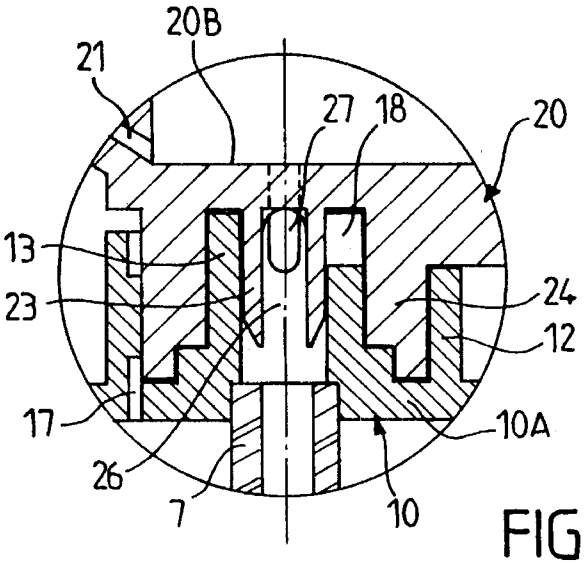
FIG. 5 is similar to FIG. 4, the dispensing head being in the closed position.

FIGS. 3 to 5 show an alternative embodiment of a dispensing assembly according to the invention; this alternative embodiment is of the kind of that described previously, the pieces of which it is composed, which are identical or which act in the same way as those of the previous embodiment bear the same reference; this alternative embodiment differs from the previous embodiment in that it is the rigid bottle 1 which forms the container containing the product to be dispensed; a dip tube 7, connected at its upper part to the internal outer skirt 13 of the support 10, goes down to near the bottom of the bottle 1; at the upper part of the bottle, means are provided for venting to atmosphere the upper volume of the bottle 1 located above the product which it contains; these atmosphere-venting means are formed by an axial groove 17 provided in the inner surface of the external outer skirt 12 of the support 10 and emerging into the bottle 1, and by another axial groove 28 provided in the outer surface of the outer tubular part 24 of the dispensing head 20 and emerging on the outside of the bottle 1; the position of the axial grooves 17 and 28 is such that venting to atmosphere takes place, or does not take place, depending on whether the communication between the chamber 50 and the bottle 1 is open (FIG. 4) or closed (FIG. 5).

Figure 6:
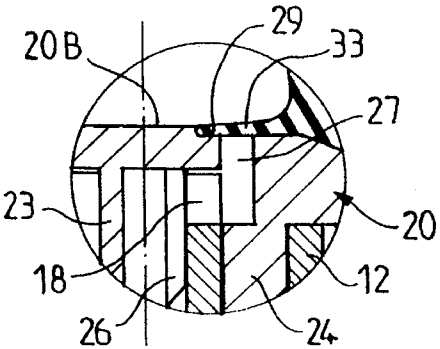
FIG. 6 is a partial view of FIG. 4 showing an alternative embodiment for the inset of the inlet valve.

According to FIG. 6, the suction valve 33 is placed in a rabbet 29 provided in the surface of the bottom 20B; the rabbet 29 has a shape corresponding to that of the valve 33 and provides better transverse retention of the said valve 33, thereby increasing its lifetime.

Figure 8:
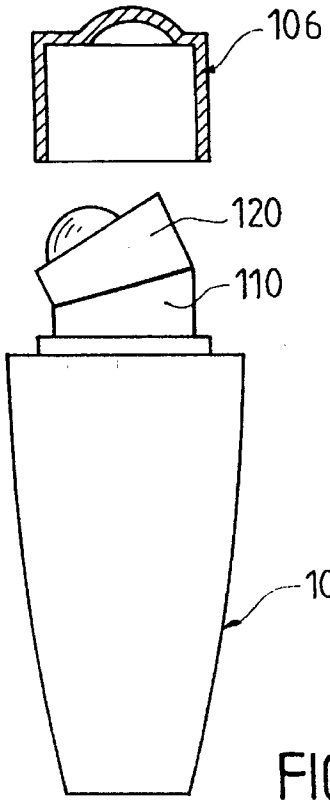
FIG. 8 depicts the assembly of FIG. 7 in the configuration which it possesses for dispensing the product.
Figure 7:
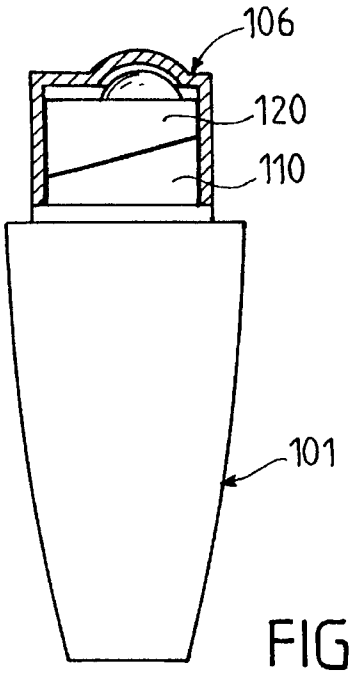
FIG. 7 is an elevation view of another dispensing assembly according to the invention in the configuration which it possesses during storage.

Of course, the correct behaviour over time of the product contained in the container of the dispensing assemblies which have just been described requires that the user, after use, rotates the dispensing head 20 with respect to the support 10 in order to close the communication between the container and the chamber 50; this operation is not natural, as is the case consisting of placing the overcap 6 onto the bottle 1; the alternative embodiment of FIGS. 7 and 8 shows a dispensing assembly endowed with a polarizing function allowing the overcap to be placed only if the abovementioned communication is closed; for this purpose, the bottle 101 bears a support 110 of a dispensing head 120 mounted so as to rotate on the support 110 in a plane which is inclined with respect to the axis of the bottle 101; in the position of the head 120, illustrated in FIG. 7, for which the said communication is closed, the support 110 and the head 120 have matching cylindrical outer contours allowing a perfectly cylindrical overcap 106 to be put into place; as may be seen in FIG. 8, in the dispensing position, the axes of the support 110 and the head 120 make an angle between them and it is not possible to put the overcap 106 onto the assembly; in this dispensing position, it should be noted that, with the user holding the bottle 101, dispensing of the product is facilitated.

Figure 12:
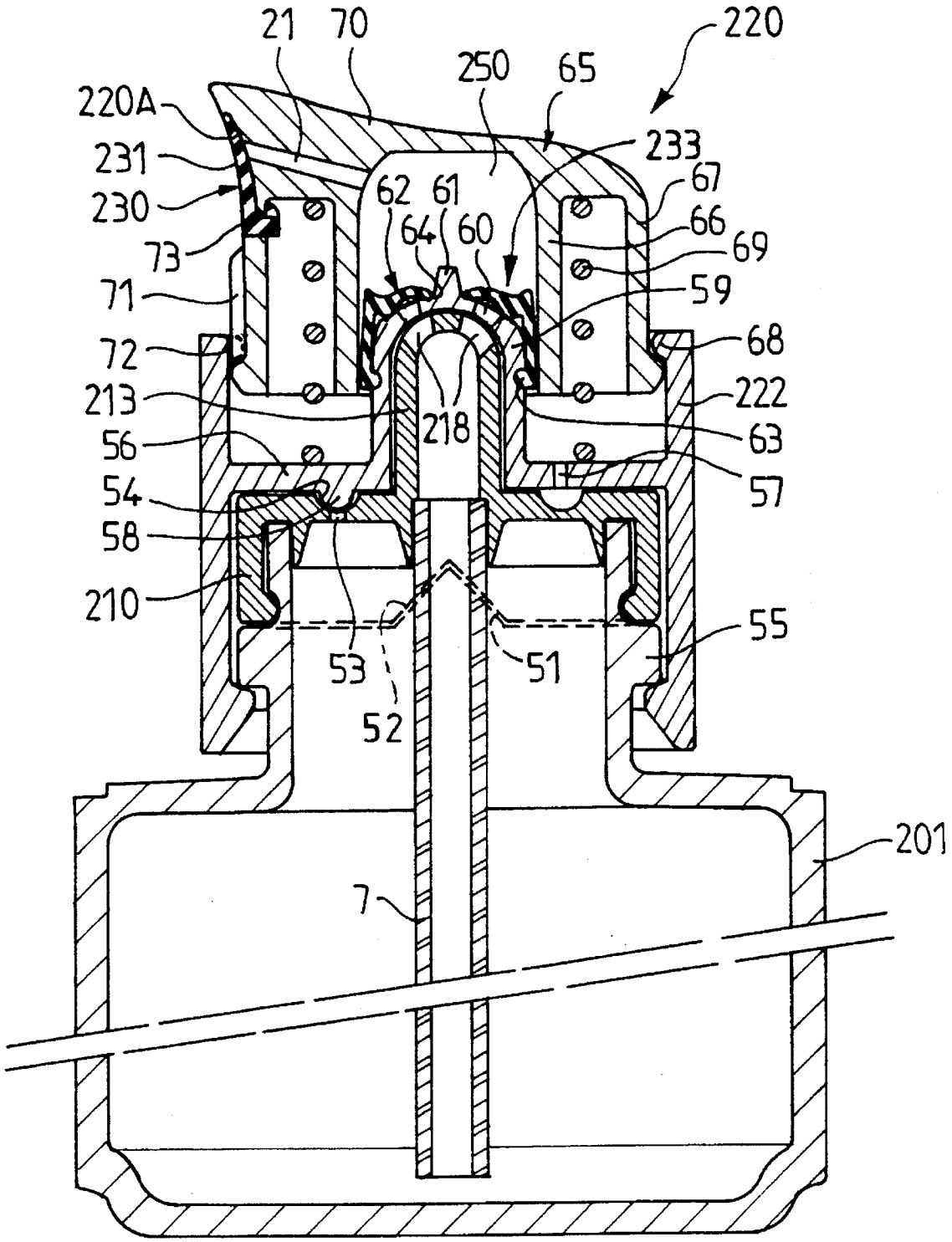
FIG. 12, finally, is a sectional partial view of another alternative embodiment.

FIG. 12 illustrates an alternative embodiment for which the identical elements, or those playing a similar role to elements already described with regard to FIGS. 1 to 6, are designated by the same numerical differences, possibly increased by the number 200. They will not be described again, or only briefly.

The neck of the bottle 201 is equipped with a support 210 for the dispensing head 220. The support 210 possesses a skirt snap-fastened to the neck and prevented from moving rotationally relative to this neck, for example by interaction of a triangular projection 51 provided on the outer wall of the neck, and of a conjugate indentation 52 provided in the skirt of the support 210. This support 210 possesses a flat region which is orthogonal to the axis of the neck and through which passes an air-uptake hole 53 emerging into a cup 54. The central part of the flat region possesses a thimble-shaped projection 213 on the side opposite the bottle 201. The upper end of the projection 213 has the shape of a dome and passages 218 pass through this upper end. The dip tube 7 is tightly engaged, by its upper end, inside the projection 213.

The dispensing head 220 comprises an outer ferrule 222 mounted so as to rotate on the support 210. This ferrule possesses a skirt fastened beneath a peripheral shoulder 55 of the neck of the bottle. The ferrule 222 furthermore possesses a flat region 56, orthogonal to the axis of the neck, applied against the flat region of the support 210. Passing through the flat region 56 is an air-uptake hole 57 arranged so as to be able to come in line with the air-uptake hole 53, by rotation of the ferrule 222. A boss 58 is provided as a projection under the flat region 56, diametrically opposite the air-uptake hole 57 in relation to the axis of the neck. The boss 58 has a shape conjugate to that of the cup 54, so as to close the hole 53 in a sealed manner and to stop the ferrule 222 from rotating relative to the support 210 when this boss 58 is received in the cup 54, as illustrated in FIG. 12. Another cup 54, diametrically opposite the hole 53, is provided on the flat region of the support 210.

In its central part, the flat region 56 of the ferrule possesses a dome-shaped projection 59, the inner surface of which matches the outer surface of the projection 213. The upper end, of convex rounded shape, of the projection 59 possesses at least one passage 60; this or these passages 60 are arranged so as to be in line with the passages 218, at least when the ferrule 222 occupies the angular position for which the air-uptake hole 57 is in line with the air-uptake hole 53. It is also possible to provide an arrangement of the passage or passages 60 such that they remain in communication with the passages 218 when the hole 53 is closed by the boss 58.

At its top, the projection 59 possesses a coaxial frusto-conical stud 61 protruding upwards. A flexible diaphragm 62, especially made of elastomer, forming a cap, sits on top of the rounded end of the projection 59 and is anchored by an internal shoulder 63, at its lower end, in a peripheral annular groove in the projection 59. The upper transverse wall of the diaphragm 62 is advantageously corrugated and possesses, at its centre, a circular orifice 64 in which the stud 61 is engaged. The springiness of the diaphragm 62 ensures sealed application of the edge of the orifice 64 against the stud 61. If an overpressure occurs in the rigid-walled or semi-rigid-walled container 201, the flat region of the diaphragm lifts up and an annular space is formed between the edge of the hole 64 and the wall of the stud 61, in order for the product to pass.

A push-button 65, of cylindrical general shape, is mounted so as to slide, in the direction of the axis of the neck of the bottle, on the ferrule 222. This button 65 possesses an internal cylindrical skirt 66 which surrounds, in a sealed manner, a cylindrical skirt of the diaphragm 62. The combination of the projection 59 and the diaphragm 62 forms a valve-piston 233 sliding in the cylinder delimited by the skirt 66. The push-button 65 possesses an external cylindrical skirt 67 equipped, at the bottom, with an outer shoulder suitable for being caught under an internal rim 68 of the ferrule 222. A helical return spring 69 is arranged in the annular space lying between the skirts 66 and 67 and bears, at one end, against the flat region 56 and, at its other end, against the upper transverse wall 70 of the push-button 65.

The external cylindrical skirt 67 possesses indexing means for stopping the push-button 65 from rotating relative to the ferrule 222. These indexing means comprise, for example, a longitudinal rib 71, parallel to the axis of the push-button, provided on the outer surface of the external cylindrical skirt 67 and received in a conjugate notch 72 provided in the rim 68. The push-button 65 thus rotates with the ferrule 222 and forms part of the dispensing head 220. A pumping chamber 250 is formed above the diaphragm 62, in the push-button 65, radially inside the internal cylindrical skirt 66.

The dispensing channel 21 extends transversely in the upper transverse wall 70, between the upper part of the chamber 250 and the external lateral surface of the internal cylindrical skirt 67. The terminal part of the dispensing channel 21 emerges into a bearing surface 220A provided on the outer lateral surface of the external cylindrical skirt 67. The bearing surface 220A is substantially plane, in particular slightly concave towards the outside.

The head 220, by means of its push-button 65, bears, at its upper part, a flexible diaphragm 230 having a bevelled profile defining a springy leaf 231 which is applied against the bearing surface 220A, at least in the zone into which the dispensing channel 21 emerges. At its lower end, the flexible diaphragm 230 possesses a heel 73, the direction of which is substantially orthogonal to that of the leaf 231. This heel 73 is anchored in a hole in the external cylindrical skirt 67 so as to exert an elastic return force of the leaf 231 against the bearing surface 220A.

The operation of the dispensing assembly of FIG. 12 is as follows.

The storage or rest position is obtained by placing the ferrule 222 in the position of FIG. 12 in which the boss 58 closes the air-uptake hole 53. It is also possible to provide closure of the passages 218 via the dome of the projection 59, for this angular position.

In order to dispense the product, the ferrule 222 is rotated through 180° with respect to the position illustrated in FIG. 12, about the axis of the neck. The boss 58 is received in the cup 54 diametrically opposite the air-uptake hole 53, thereby keeping the ferrule 222 in the chosen position. The air-uptake hole 57 located in line with the air-uptake hole 53 permits air uptake into the bottle 201, from the space located beneath the push-button 65, outside the inner cylindrical skirt 66, which space is in communication with the atmosphere. On exerting a pumping action, by pressing-in and releasing the push-button 65, the product is made to rise in the tube 7 and into the chamber 250 after crossing the diaphragm 62 which acts as a non-return valve; the product leaves via the dispensing channel 21 with the springy leaf 231 forced out. As soon as action on the push-button 65 ceases, the product remaining in the dispensing channel 21 and in the chamber 250 is protected from the atmosphere by virtue of the springy leaf 231.

The rotating ferrule 222 provides both for the product to pass and for the rigid or semi-rigid bottle 201 to be subjected to atmospheric pressure.

I claim:

1. Assembly for dispensing a liquid to pasty product, comprising:

a container holding the product and having a rigidity such that the dispensing of the product requires air-uptake by the container;

a dispensing head having an upper portion and a dispensing channel comprising a first terminal part and a second terminal part;

a two-valve pumping member, having an inlet valve and a dispensing valve, for dispensing the product, said two-valve pumping member lacking an air-uptake;

means for establishing or preventing air-uptake by the container;

said dispensing head comprising a bearing surface having an end through which the first terminal part of the dispensing channel passes and opens to an outside of the container, and said dispensing head further comprising, in its upper portion, a flexible diaphragm having a bevelled profile defining a springy leaf applied against the end of the bearing surface.

2. Assembly according to claim 1, wherein the dispensing head has a center and the bearing surface is interrupted at said center by a hollowed region forming a compression chamber, having a bottom and into which the second terminal part of the dispensing channel emerges.

3. Assembly according to claim 2, wherein the compression chamber is bordered by a dome, which includes the flexible diaphragm in line with the bottom of the compression chamber.

4. Assembly according to claim 1, further comprising communication means for selectively establishing or preventing communication between the dispensing channel and the container, said communication means including the dispensing head being mounted so as to move, with respect to the container between two positions, a first position for which the dispensing channel is in communication with the container and a second position for which the dispensing channel is not in communication with the container.

5. Assembly according to claim 4, wherein the dispensing channel is in communication with the container when said dispensing head is in said first position, and the dispensing channel is not in communication with the container when said dispensing head is in said second position.

6. Assembly according to claim 2, wherein the dispensing head is rotatably mounted with respect to the container.

7. Assembly according to claim 6, wherein the container consists of a bottle having a support fixed thereto, the dispensing head being axially integral with said support and free to rotate with respect to said support.

8. Assembly according to claim 7, wherein the support comprises an internal outer skirt sealingly housed in an annular space between an internal tubular part and an external tubular part of the dispensing head.

9. Assembly according to claim 8, further comprising a port passing through a wall of the internal outer skirt of the support, said internal tubular part having a longitudinal slot and said external tubular part having a passage, said longitudinal slot and said passage facing each other, said passage emerging into the compression chamber and including the inlet valve, said internal outer skirt of the support and said internal tubular part of the dispensing head communicating with the container, said longitudinal slot and said passage being arranged so as to face the port in the first position of the dispensing head for which the compression chamber is in communication with the container, and therefore the dispensing channel is in communication with the container.

10. Assembly according to claim 8, further comprising a dip tube extending toward a lower part of the bottle and being connected, in an upper part of the bottle, to the internal outer skirt of the support, and venting means for venting an upper part of the container to the atmosphere.

11. Assembly according to claim 10, wherein the venting means comprise a first axial groove in an inner surface of an external outer skirt of the support and a second axial groove in an outer surface of the outer tubular part of the dispensing head, said first axial groove emerging into the container and said second axial groove emerging outside of the container.

12. Assembly according to claim 1, wherein the dispensing head is rotatably mounted with respect to the container, said dispensing head comprising a ferrule mounted so as to rotate on a support fixed to a neck of the container, said ferrule adapted to open and close an air-uptake hole in the container, said ferrule comprising a valve-piston in a central part of the dispensing head interacting with a pumping chamber defined within a push-button on top of the ferrule.

13. Assembly according to claim 12, wherein the valve-piston comprises a projection in a central part of a flat region of the ferrule, said projection having an upper dome-shaped end, which has at least one passage covered by a springy diaphragm having a cylindrical wall which slides in a sealed manner in an internal skirt of the push-button.

14. Assembly according to claim 13, wherein the projection of the ferrule comprises, at a top, a frustoconical stud engaged in a circular orifice in the diaphragm.

15. Assembly according to claim 12, wherein the dispensing channel emerges on a lateral wall of the push-button, said bearing surface being located on said lateral wall.

* * * * *

UNITED STATES PATENT AND TRADEMARK OFFICE

CERTIFICATE OF CORRECTION

PATENT NO. : 5,492,252

DATED : February 20, 1996

INVENTOR(S) : Jean-Louis H. GUERET

It is certified that error appears in the above-indentified patent and that said Letters Patent is hereby corrected as shown below:

Title page, item [54] and col. 1, line 1, change "DUE" to --ABLE--.
In the title, change "DUE" to --ABLE--.

Signed and Sealed this

Seventh Day of May, 1996

Bruce Lehman

BRUCE LEHMAN

*Commissioner of Patents and Trademarks*

*Attest:*

*Attesting Officer*